US007062994B2

(12) United States Patent
Chen

(10) Patent No.: US 7,062,994 B2
(45) Date of Patent: Jun. 20, 2006

(54) RATCHET WRENCH

(76) Inventor: Ching Chen, No. 1, Alley 2, Lane 741, Tung-Ping Rd., Taiping City, Taichung Hsien (TW)

( * ) Notice: Subject to any disclaimer, the term of this patent is extended or adjusted under 35 U.S.C. 154(b) by 70 days.

(21) Appl. No.: 10/965,923

(22) Filed: Oct. 14, 2004

(65) Prior Publication Data

US 2006/0081092 A1 Apr. 20, 2006

(51) Int. Cl.
*B25B 13/46* (2006.01)

(52) U.S. Cl. ..... 81/63; 81/62; 81/63.2

(58) Field of Classification Search ..... 81/63, 81/60, 61, 62, 63.2
See application file for complete search history.

(56) References Cited

U.S. PATENT DOCUMENTS 6,435,063 B1 * 8/2002 Chen ..... 81/63.2
6,516,691 B1 * 2/2003 Wei ..... 81/63.2
6,886,428 B1 * 5/2005 Hsien ..... 81/63.2
6,945,141 B1 * 9/2005 Hu ..... 81/63.2
2003/0070512 A1 * 4/2003 Hu ..... 81/63.2

* cited by examiner

*Primary Examiner*—David B. Thomas
*Assistant Examiner*—Alvin J. Grant
(74) *Attorney, Agent, or Firm*—Pro-Techtor Int'l Services

(57) ABSTRACT

Ratchet wrench has its head comprising an opening, a recess on a wall of the opening, a channel having one end open to the recess and the other blind end in the handle, and a trough on the handle proximate the wrench head, a reversing pawl in the recess and including a top groove and a rear cavity, a push button on the trough adapted to move between first and second positions by cooperating with a spring depressible detent for carrying out clockwise driving and counterclockwise ratcheting or vice versa, a reversing lever having one portion disposed on the groove and the other portion received in a slot of the push button, a spring biaser including one end in the cavity and the other end in the blind end of the channel, and a socket fastened in the opening and being meshed with pawl teeth of the reversing pawl.

2 Claims, 8 Drawing Sheets

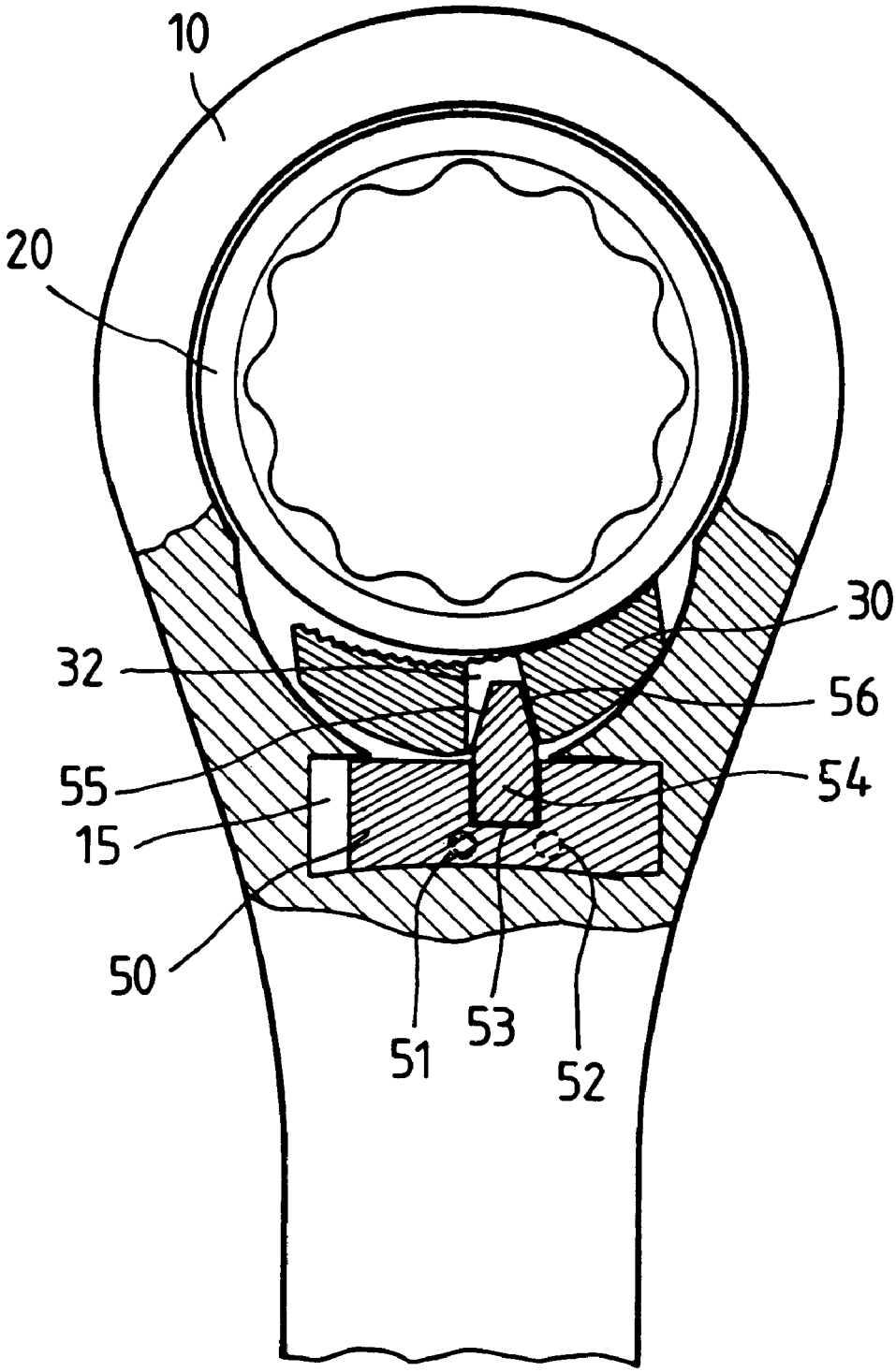
FIG, 4

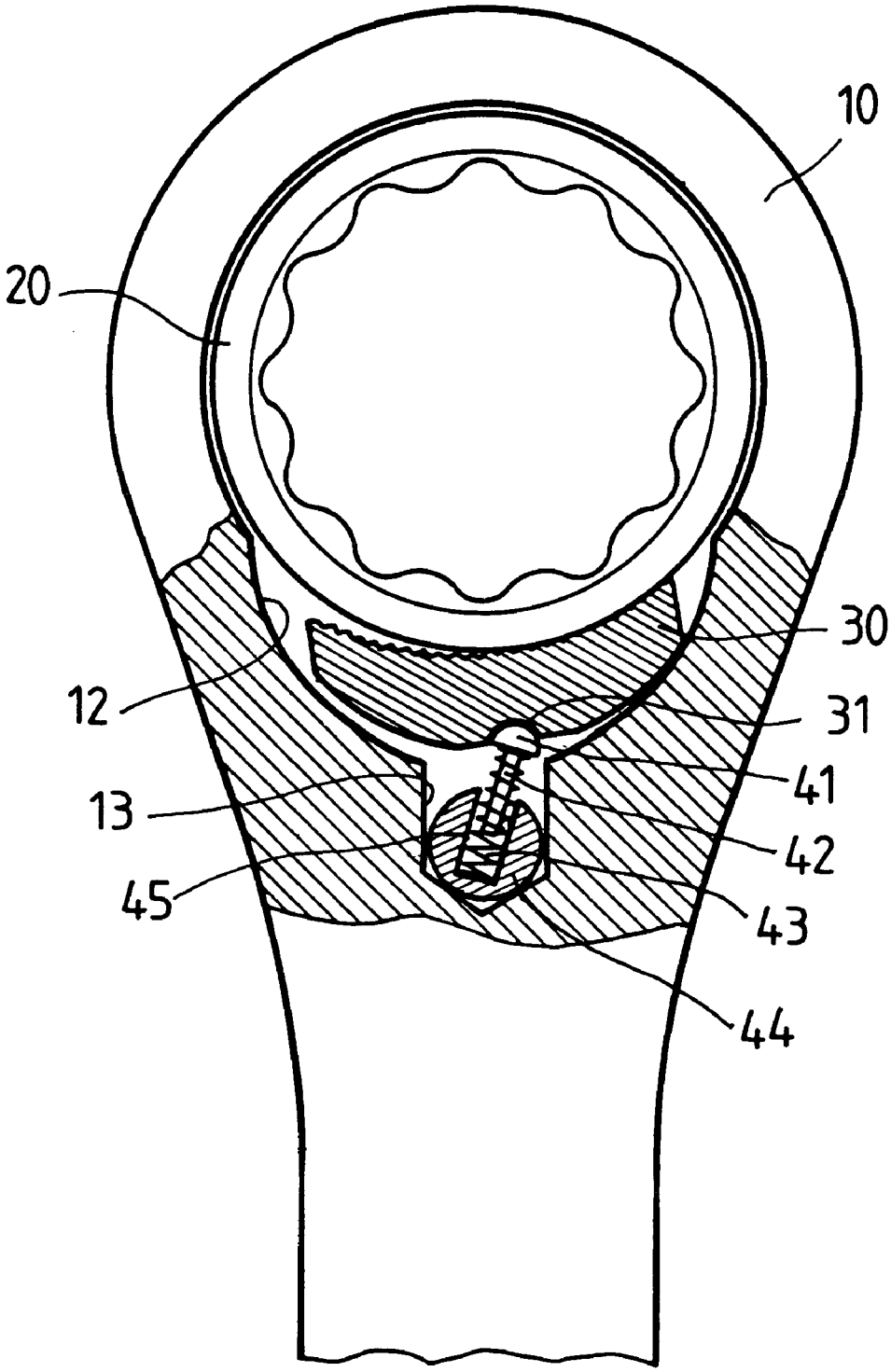
FIG, 5

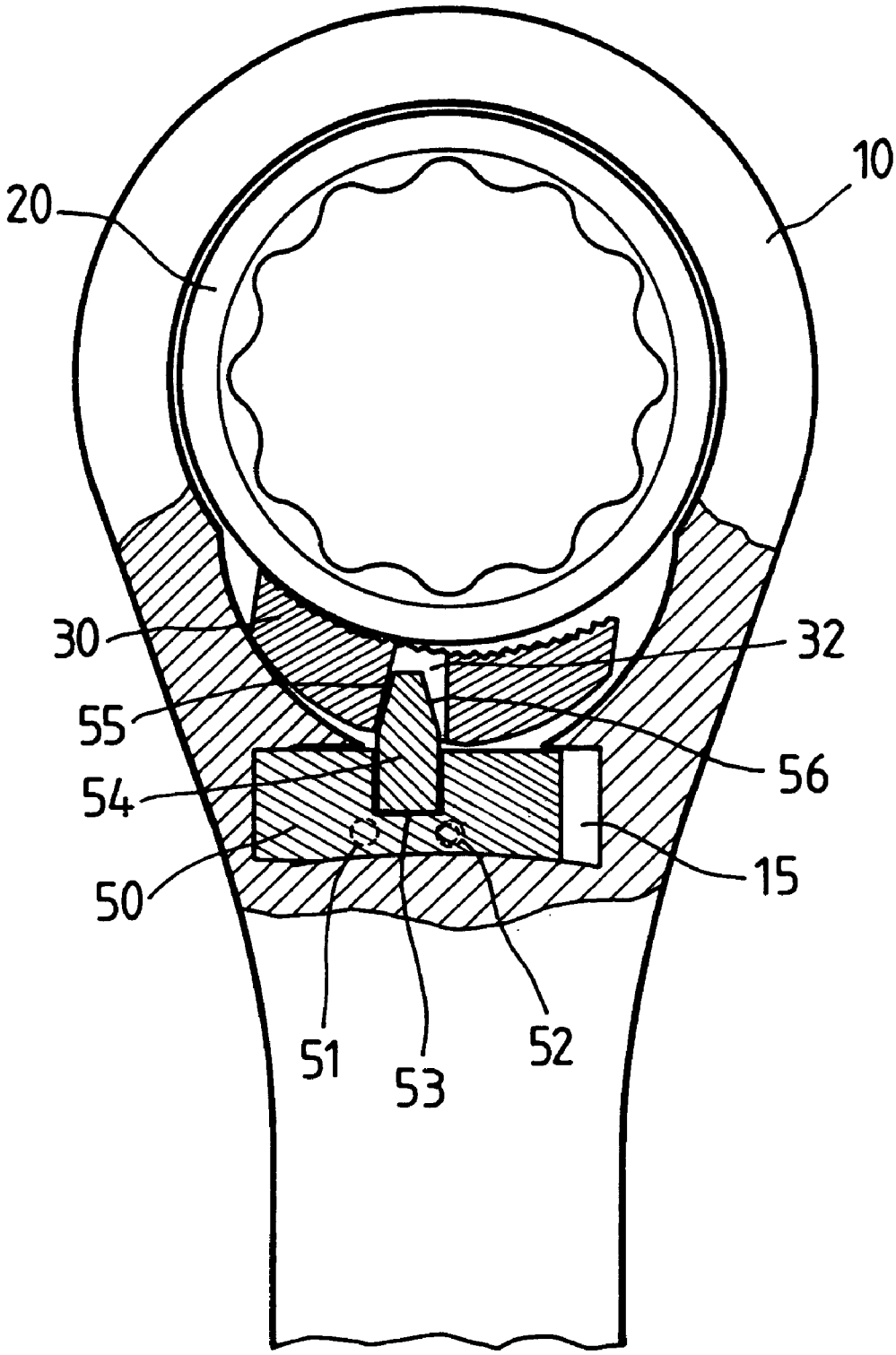
FIG, 6

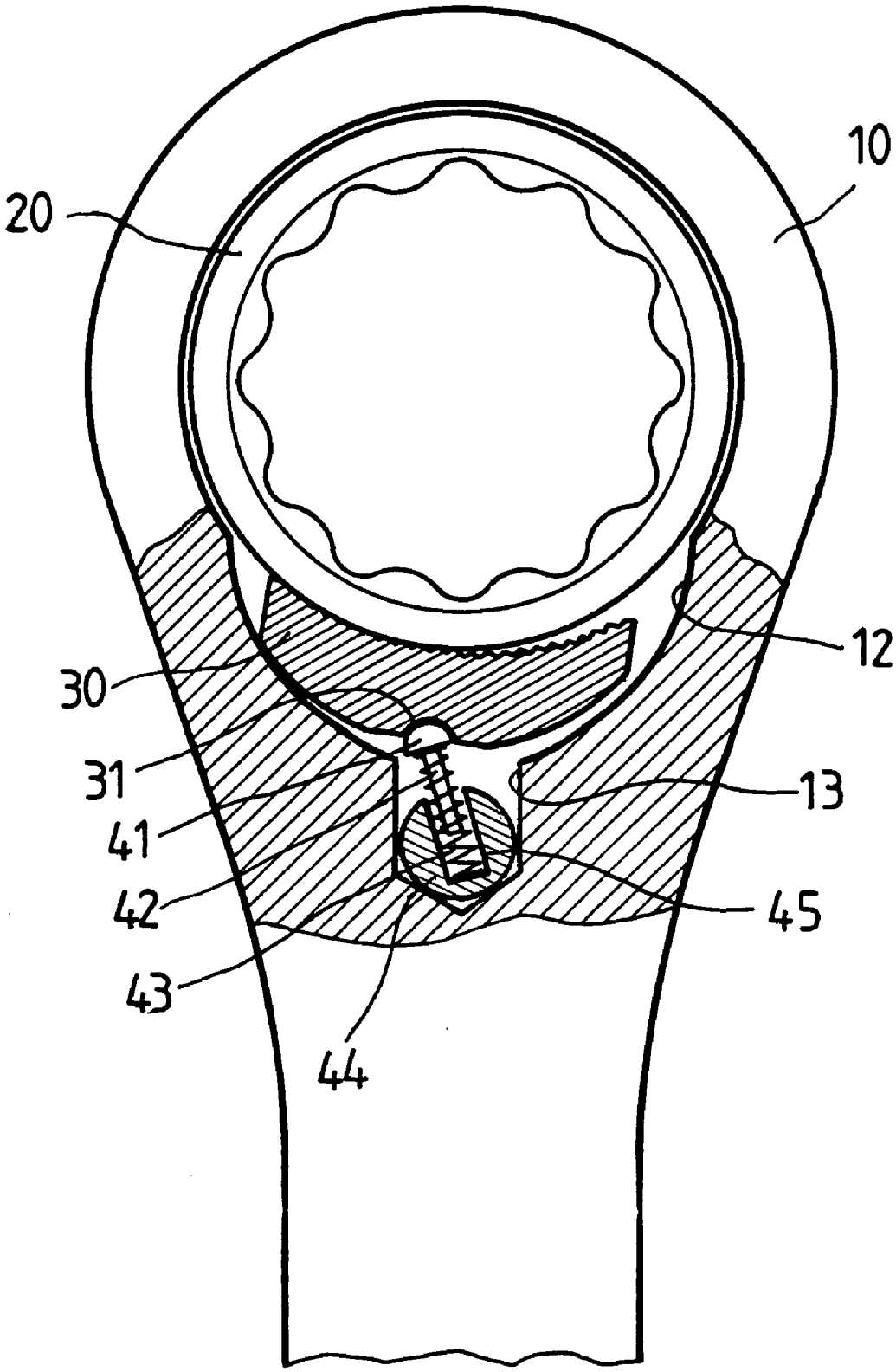
FIG,7

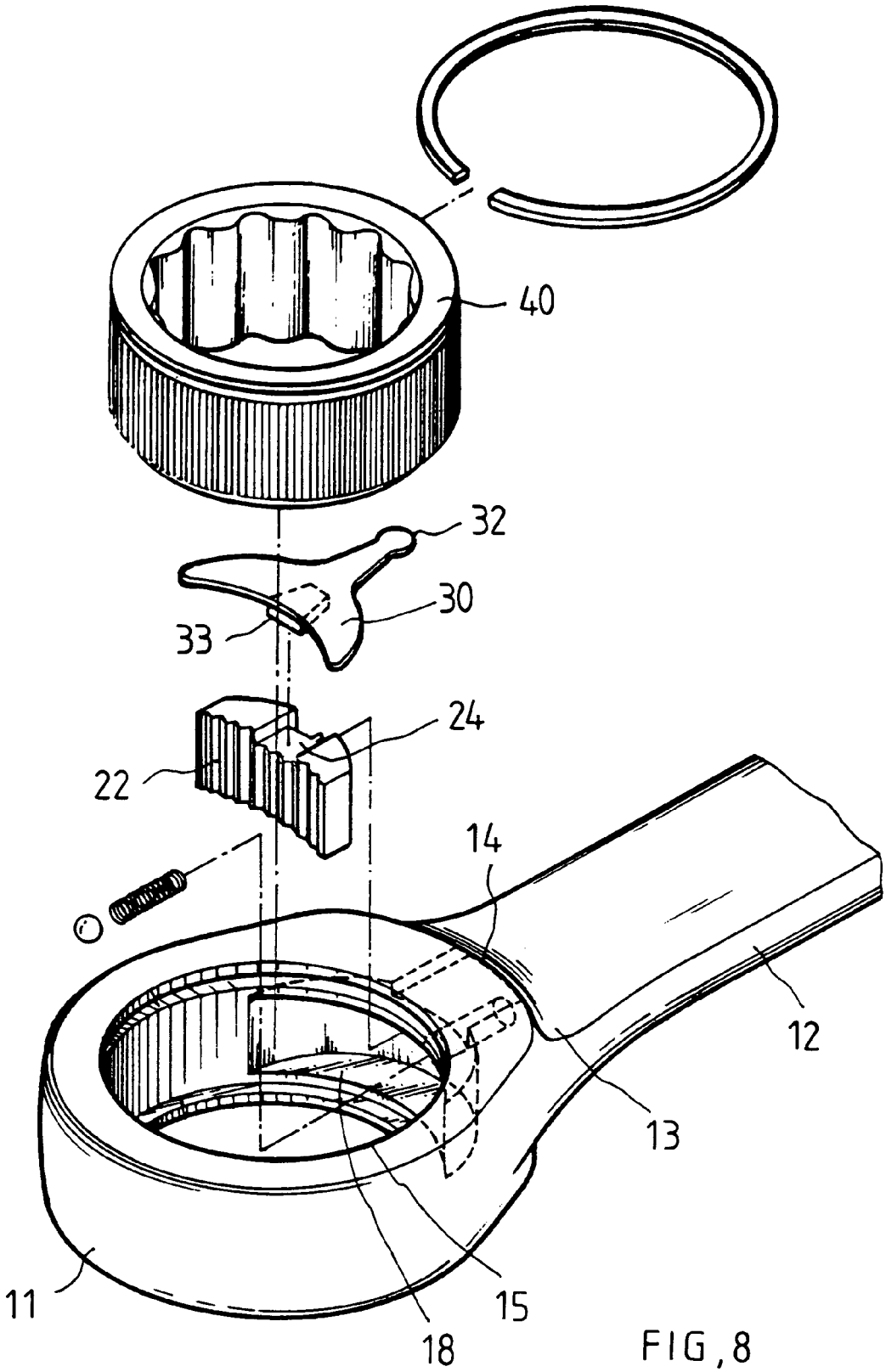
FIG, 8
PRIOR ART

RATCHET WRENCH

FIELD OF THE INVENTION

The present invention relates to wrenches and more particularly to a ratchet wrench with an improved turning direction switching mechanism for carrying out either clockwise driving and counterclockwise ratcheting or counterclockwise driving and clockwise ratcheting.

BACKGROUND OF THE INVENTION

A conventional ratchet wrench is shown in FIG. 8 and comprises a wrench head 11 and a handle 12 integrally formed therewith. The wrench head 11 comprises a circular opening 15, a recess 18 of arc section formed on the wall of the opening 15, and an internal channel 14 having one end in communication with the recess 18 and the other end in communication with an oblique shoulder 13 between the wrench head 11 and the handle 12. A reversing pawl 22 is provided in the recess 18. A groove 24 is formed on top of the reversing pawl 22. A substantially Y-shaped reversing lever 30 is disposed on the reversing pawl 22 and is received in the channel 14. The reversing lever 30 comprises a bottom projection 33 mounted in the groove 24 and a thumb tab 32 projected from both the channel 14 and the shoulder 13. A cylindrical socket 40 is fastened in the opening 15 by means of a split ring as known in the art and comprises external ratchet teeth meshed with external pawl teeth of the reversing pawl 22 and internal drive teeth adapted to engage with a member (e.g., bolt head) to be torqued. A user may move the reversing lever 30 by manipulating the thumb tab 32 in a distance defined by the width of the channel 14 for switching clockwise driving and counterclockwise ratcheting to counterclockwise driving and clockwise ratcheting or vice versa.

However, the prior art suffered from several disadvantages. For example, it is difficult to mold the channel 14 since height of the shoulder 13 is relatively small. Moreover, the form of the structure is not precise. Height of the shoulder 13 may increase for overcoming the above disadvantages. However, it may detract from its external appearance. A user may have difficulty in manipulating the thumb tab 32 by the fingers since it is flat and is very close to the surface of the handle 12. This is particularly difficult if a user wears a glove during operation. Thus, the need for improvement still exists.

SUMMARY OF THE INVENTION

It is an object of the present invention to provide a ratchet wrench comprising a handle; a head section integrally formed with the handle, the head section comprising a circular opening, a recess formed on a wall of the opening aligned with the handle, an internal channel having one end in communication with the recess and the other blind end in the handle, and a trough disposed on a joining portion of the handle and the head section; a reversing pawl provided in the recess and comprising a top groove, a cavity formed on a center of an internal arc surface thereof, and external pawl teeth; a push button slidably provided on the trough and comprising a tapered, knurled top projected above the handle, a front slot, and first and second dents on its bottom; a spring depressible detent having one end anchored on the trough and the other end moveably disposed in either the first dent or the second dent; a reversing lever partially provided on the groove and partially received in the slot, the reversing lever comprising oblique, opposite sides either being adapted to snugly engage with either mating side of the groove; a biaser comprising one end provided in the cavity, the other end provided in the blind end of the channel, and a resilient device biased against both ends thereof; and a socket fastened in the opening and comprising external ratchet teeth meshed with external pawl teeth of the reversing pawl and internal drive teeth; whereby pushing the push button to a first direction will pivot the biaser toward the first direction relative to the channel, move the other end of the detent from the first dent to the second dent, engage one side of the reversing lever with one side of the groove and disengage the other side thereof from the other side of the groove, mesh a substantially first half portion of the external pawl teeth of the reversing pawl with the external ratchet teeth of the socket, urge a substantially first half portion of the internal arc surface of the reversing pawl against a wall of the recess, enable a clockwise driving of the ratchet wrench with respect to a member engaged with the internal drive teeth of the socket, and carry out a counterclockwise ratcheting of the ratchet wrench; and whereby pushing the push button to a second direction opposite the first direction will pivot the biaser toward the second direction relative to the channel, move the other end of the detent from the second dent to the first dent, engage the other side of the reversing lever with the other side of the groove and disengage one side thereof from one side of the groove, mesh a substantially second half portion of the external pawl teeth of the reversing pawl with the external ratchet teeth of the socket, urge a substantially second half portion of the internal arc surface of the reversing pawl against the wall of the recess, enable a counterclockwise driving of the ratchet wrench with respect to a member engaged with the internal drive teeth of the socket, and carry out a clockwise ratcheting of the ratchet wrench. By utilizing the present invention, the above drawbacks of the prior art are substantially eliminated.

In one aspect of the present invention, one end of the biaser is formed as a half spherical head provided in the cavity the other end of the biaser is formed as a ball engaged with the blind end of the channel, the ball having an aperture facing the resilient device, and the resilient device comprises a bar extended from the half spherical head of the biaser, and a compression spring put on the bar, rear portions of both the compression spring and the bar being disposed in the aperture.

The above and other objects, features and advantages of the present invention will become apparent from the following detailed description taken with the accompanying drawings.

BRIEF DESCRIPTION OF THE DRAWINGS

FIG. 4 is a top plan view in part section of the wrench head showing the locations of the reversing pawl, the reversing lever, and the reversing lever when counterclockwise ratcheting and clockwise driving of the ratchet wrench are carried out;

FIG. 5 is a top plan view in part section of the wrench head showing the locations of the reversing pawl and the components of biaser when counterclockwise ratcheting and clockwise driving of the ratchet wrench are carried out;

FIG. 6 is a top plan view in part section of the wrench head showing the locations of the reversing pawl, the reversing lever, and the reversing lever when counterclockwise driving and clockwise ratcheting of the ratchet wrench are carried out;

FIG. 7 is a top plan view in part section of the wrench head showing the locations of the reversing pawl and the components of biaser when counterclockwise driving and clockwise ratcheting of the ratchet wrench are carried out; and FIG. 8 is an exploded view of the head portion of a conventional ratchet wrench.

DETAILED DESCRIPTION OF THE PREFERRED EMBODIMENTS

Figure 1:
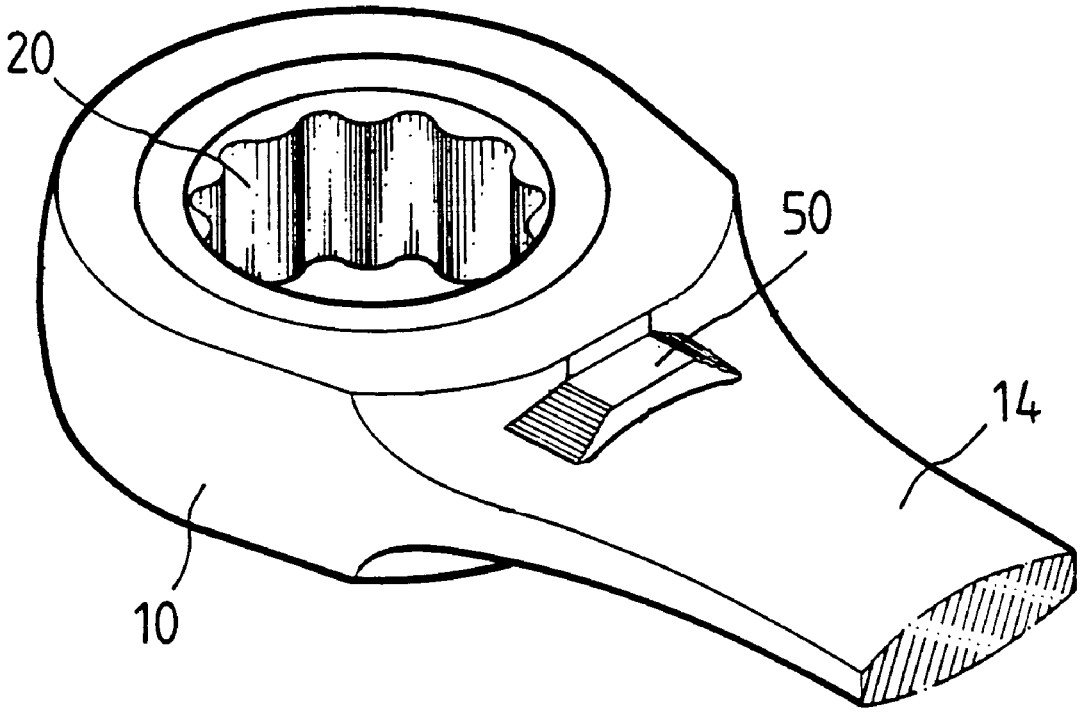
FIG. 1 is a partial, perspective view of a preferred embodiment of ratchet wrench according to the invention.
Figure 2:
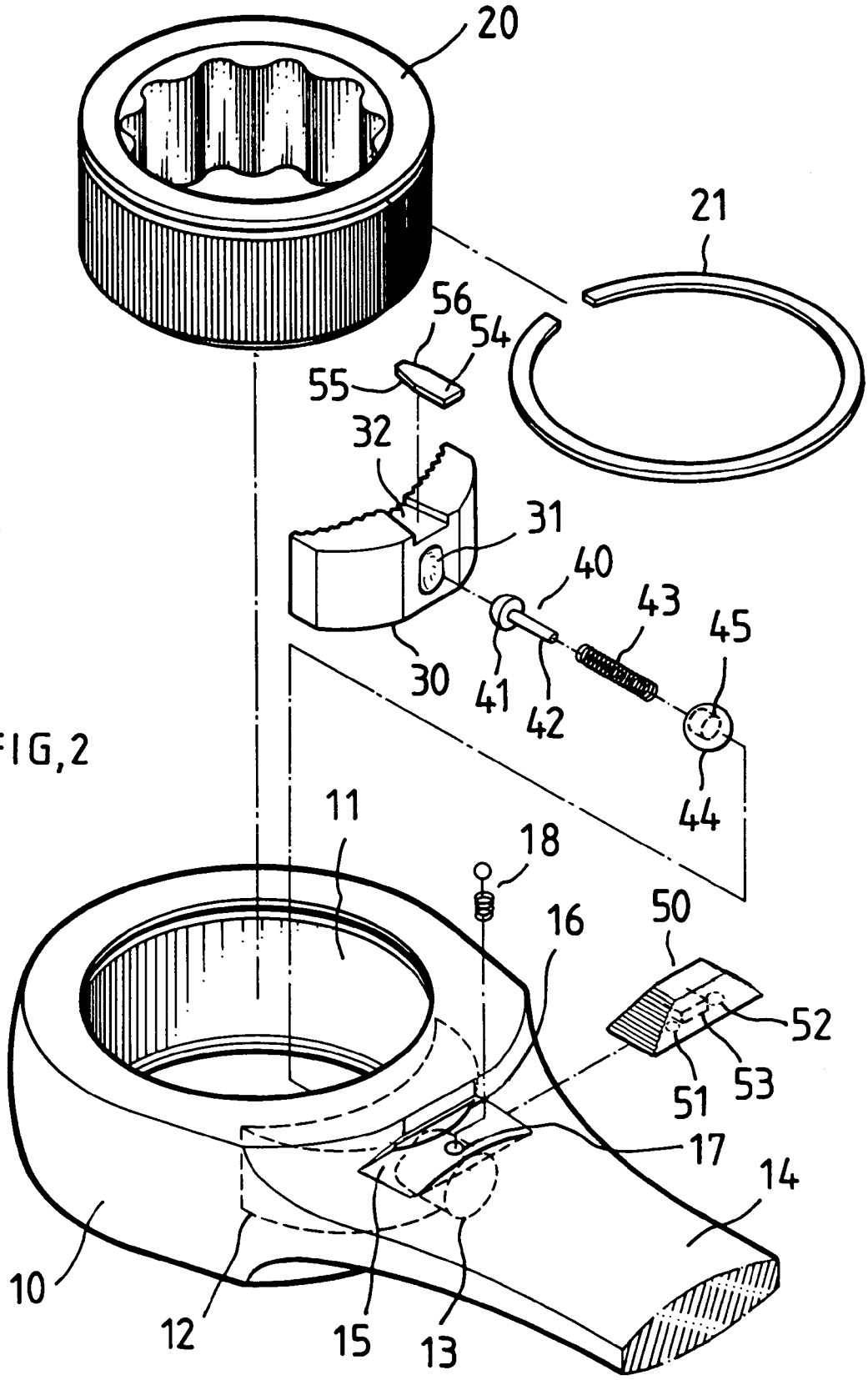
FIG. 2 is an exploded view of the head portion of the ratchet wrench.
Figure 3:
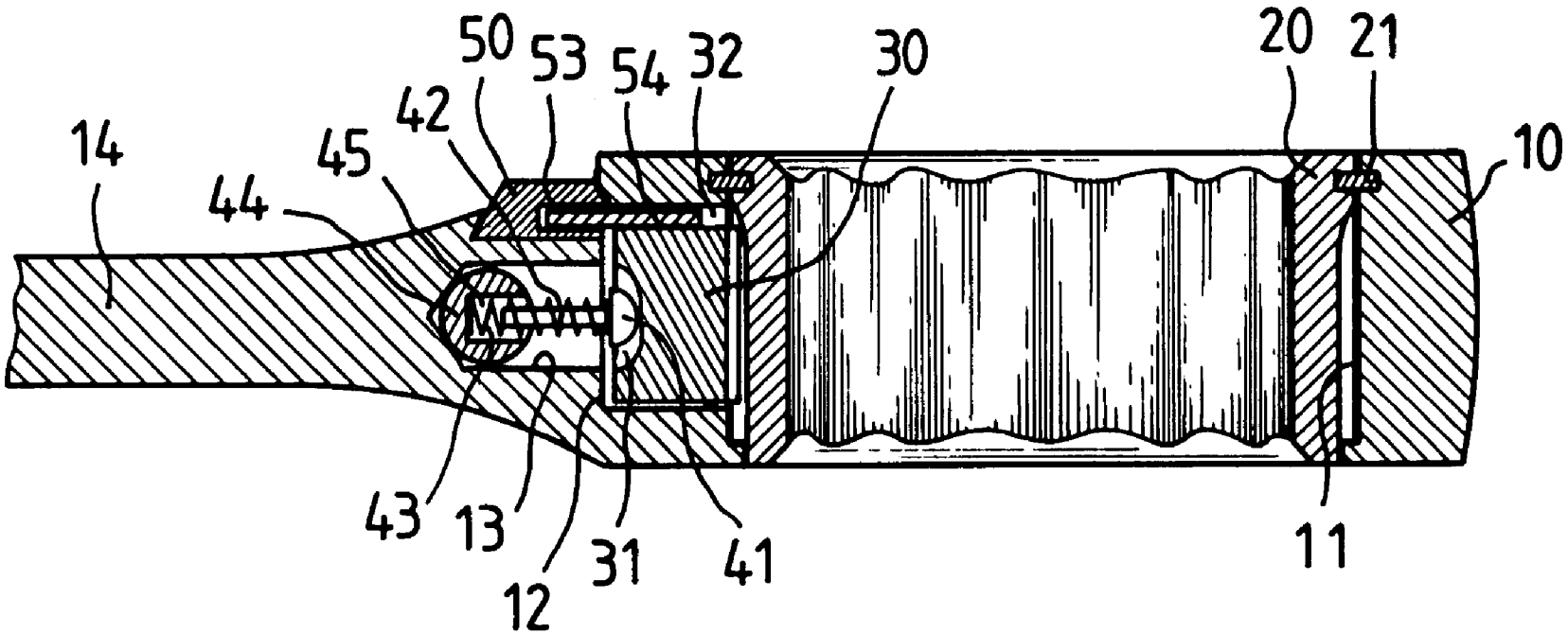
FIG. 3 is a sectional view of the ratchet wrench.

Referring to FIGS. 1 to 3, there is shown a ratchet wrench constructed in accordance with a preferred embodiment of the invention comprising a wrench head 10 and a handle 14 integrally formed therewith. The wrench head 10 comprises a circular opening 11, a recess 12 of arc section formed on the wall of the opening 11, an internal channel 13 having one end in communication with the recess 12 and the other blind, tapered end in the handle 14, and a trough 15 on the shoulder between the handle 14 and the wrench head 10. A reversing pawl 30 is provided in the recess 12. A groove 32 is formed on top of the reversing pawl 30 and a half spherical cavity 31 is formed on a center of the internal arc surface thereof. A push button 50 is provided on the trough 15. The push button 50 has a tapered top projected above the handle 14 and knurled oblique sides for ease of moving by the fingers. The push button 50 further comprises a front slot 53 and two dents 51 and 52 on its bottom. A spring depressible detent 18 has one end anchored in a bottom hole on the trough 15 and the other end (i.e., ball) moveably disposed in either dent 51 or 52 when the push button 50 is moved by pushing by the finger as detailed later. A flat reversing lever 54 is partially provided on the groove 32 and is partially received in the slot 53. The reversing lever 54 comprises two oblique sides 55 and 56 either being adapted to snugly engage with either mating side of the groove 32. A biaser 40 comprises a half spherical head 41 provided in the cavity 31, a bar 42 extended rearwards, a helical spring 43 put on the bar 42, a ball 44 engaged with the blind end of the channel 13, and an aperture 45 formed in the ball 44 with the rear portions of both the spring 43 and the bar 42 disposed therein. The spring 43 thus exerts an expansion force to urge the ball 44 against the blind end of the channel 13 and the head 41 against the cavity 31 respectively. A cylindrical socket 20 is fastened in the opening 11 by means of a split ring 21 as well known in the art and comprises external ratchet teeth meshed with external pawl teeth of the reversing pawl 30 and internal drive teeth adapted to engage with a member (e.g., bolt head) to be torqued.

Operations of the ratchet wrench will be described in detailed below. Referring to FIGS. 4 and 5 in conjunction with FIGS. 1 to 3, a user uses the finger to push the push button 50 to the right and thus the ball of the detent 18 moves from the other dent 52 to one dent 51. Also, one side 56 of the reversing lever 54 is matingly engaged with one side of the groove 32 and the other side 55 thereof is disengaged from the other side of the groove 32. Further, substantially right half portion of the external pawl teeth of the reversing pawl 30 is meshed with the external ratchet teeth of the socket 20 and substantially right half portion of the internal arc surface of the reversing pawl 30 is urged against the wall of the recess 12 as a result of the biaser 40 pivoting rightward relative to the channel 13. At this position, a user can turn the ratchet wrench clockwise to torque a member (e.g., bolt head) engaged with the internal drive teeth of the socket 20 while a counterclockwise ratcheting of the wrench is carried out.

Referring to FIGS. 6 and 7 in conjunction with FIGS. 1 to 3, a user pushes the push button 50 to the left and thus the ball of the detent 18 moves from one dent 51 to the other dent 52. Also, the other side 55 of the reversing lever 54 is matingly engaged with the other side of the groove 32 and one side 56 thereof is disengaged from one side of the groove 32. Further, substantially left half portion of the external pawl teeth of the reversing pawl 30 is meshed with the external ratchet teeth of the socket 20 and substantially left half portion of the internal arc surface of the reversing pawl 30 is urged against the wall of the recess 12 as a result of the biaser 40 pivoting leftward relative to the channel 13. At this position, a user can turn the ratchet wrench counterclockwise to torque a member (e.g., bolt head) engaged with the internal drive teeth of the socket 20 while a clockwise ratcheting of the wrench is carried out.

While the invention herein disclosed has been described by means of specific embodiments, numerous modifications and variations could be made thereto by those skilled in the art without departing from the scope and spirit of the invention set forth in the claims.

What is claimed is:

1. A ratchet wrench comprising:

a handle;

a head section integrally formed with the handle, the head section comprising a circular opening, a recess formed on a wall of the opening aligned with the handle, an internal channel having one end in communication with the recess and the other blind end in the handle, and a trough disposed on a joining portion of the handle and the head section;

a reversing pawl provided in the recess and comprising a top groove, a cavity formed on a center of an internal arc surface thereof, and external pawl teeth;

a push button slidably provided on the trough and comprising a tapered, knurled top projected above the handle, a front slot, and first and second dents on its bottom;

a spring depressible detent having one end anchored on the trough and the other end moveably disposed in either the first dent or the second dent;

a reversing lever partially provided on the groove and partially received in the slot, the reversing lever comprising oblique, opposite sides either being adapted to snugly engage with either mating side of the groove;

a biaser comprising one end provided in the cavity, the other end provided in the blind end of the channel, and a resilient device biased against both ends thereof; and a socket fastened in the opening and comprising external ratchet teeth meshed with external pawl teeth of the reversing pawl and internal drive teeth;

whereby pushing the push button to a first direction will pivot the biaser toward the first direction relative to the channel, move the other end of the detent from the first dent to the second dent, engage one side of the reversing lever with one side of the groove and disengage the other side thereof from the other side of the groove, mesh a substantially first half portion of the external pawl teeth of the reversing pawl with the external ratchet teeth of the socket, urge a substantially first half portion of the internal arc surface of the reversing pawl against a wall of the recess, enable a clockwise driving of the ratchet wrench with respect to a member engaged with the internal drive teeth of the socket, and carry out a counterclockwise ratcheting of the ratchet wrench; and whereby pushing the push button to a second direction opposite the first direction will pivot the biaser toward the second direction relative to the channel, move the other end of the detent from the second dent to the first dent, engage the other side of the reversing lever with the other side of the groove and disengage one side thereof from one side of the groove, mesh a substantially second half portion of the external pawl teeth of the reversing pawl with the external ratchet teeth of the socket, urge a substantially second half portion of the internal arc surface of the reversing pawl against the wall of the recess, enable a counterclockwise driving of the ratchet wrench with respect to a member engaged with the internal drive teeth of the socket and carry out a clockwise ratcheting of the ratchet wrench.

2. The ratchet wrench of claim 1, wherein one end of the biaser is formed as a half spherical head provided in the cavity the other end of the biaser is formed as a ball engaged with the blind end of the channel, the ball having an aperture facing the resilient device, and the resilient device comprises a bar extended from the half spherical head of the biaser, and a compression spring put on the bar, rear portions of both the compression spring and the bar being disposed in the aperture.

* * * * *